US005435167A

United States Patent [19]

Holliday et al.

[11] Patent Number: 5,435,167

[45] Date of Patent: Jul. 25, 1995

[54] CABLE END COMPRESSOR

[75] Inventors: Randy Holliday, Westminster; Donald A. Kesinger, Morrison, both of Colo.

[73] Assignee: CableReady, Inc., Denver, Colo.

[21] Appl. No.: 184,373

[22] Filed: Jan. 21, 1994

[51] Int. Cl.[6] ..... H01R 43/042

[52] U.S. Cl. ..... 72/410; 29/751

[58] Field of Search ..... 72/410, 409; 29/751; 81/422, 424

[56] References Cited

U.S. PATENT DOCUMENTS

| | | | |
|---|---|---|---|
| 1,625,064 | 4/1927 | Vello | 72/409 |
| 2,713,279 | 7/1955 | Harris | 72/409 |
| 2,800,042 | 7/1957 | Demler | 72/410 |
| 3,075,198 | 1/1963 | Over | 72/409 |
| 4,126,936 | 11/1978 | Koller | 72/410 |
| 4,144,738 | 3/1979 | Dziura | 72/410 |
| 4,583,811 | 4/1986 | McMills | 29/857 |
| 4,790,068 | 12/1988 | Sato | 81/422 |

OTHER PUBLICATIONS

Ben Hughes "Cable Prep" Technical Sheet.

Ripley Company "Cablematic" Ad on p. 107 of Communications Technology, Dec. 1993.

*Primary Examiner*—Daniel C. Crane

*Attorney, Agent, or Firm*—Rick Martin

[57] ABSTRACT

A cable end compressor tool can handle RG59 and RG6 cable end assemblies. The fixed end of the tool acts as a brace. A plunger pushes a cable end assembly against the fixed end. A unique hinged spacer allows a single tool to switch from RG59 to RG6 cables instantly without any disassembly/re-assembly.

8 Claims, 4 Drawing Sheets

CABLE END COMPRESSOR

CROSS REFERENCE PATENTS

U.S. Pat. No. 4,583,811 (1986) to McMills is incorporated herein by reference.

FIELD OF INVENTION

The present invention relates to crimping devices for coaxial cables.

BACKGROUND OF THE INVENTION

U.S. Pat. No. 4,583,811 (1986) to McMills is assigned to Raychem Corporation. Raychem sells the '811 coaxial cable assembly in both an RG59 and an RG6 embodiment. The RG59 has a female connecting collar that is generally 7/16" hexagonal width and 9/16" length. The cable OD is approximately 3/16". The RG6 embodiment has a female connecting collar that is generally 7/16" hexagonal width and 11/16" length. The cable OD is approximately 4/16".

The coaxial cables for the RG59 and RG6 connectors have a center conductor surrounded by a dielectric layer. The dielectric layer is surrounded with conductive shielding. The conductive shielding is surrounded by a protective outer jacket which environmentally seals the connection between an end coupling and the cable. It is critical for proper operation and maintainability of the coaxial cable that the connection between the end coupling and the cable be environmentally and electrically sealed.

The '811 patent teaches the use of a coupling assembly for attachment to the end of a length of coaxial cable. The assembly consists of the outer female connecting collar noted above. Inside the outer female connecting collar is an end coupling shaped like a cylinder having an open end for surrounding the cable, and a closed end having an opening for the cable dielectric and center conductor.

The preferred method for affixing a coupling assembly to a cable end is to use a cable end compressor tool. The function of the cable end compressor tool is to compress the cable end into the end coupling quickly with one squeeze of the tool handle.

The cable end compressor tool must have one fixed end to support the female connecting collar. A plunger is forced by the handle onto the partially closed end of the end coupling, thereby compressing the end coupling over a compressible member and against the cable end.

As noted above, the RG59 and RG6 cables have different length female connecting collars. Therefore, the distance from the fixed end of the tool to the plunger must be varied in accordance with the appropriate RG59, RG6 etc. female connecting collar in order to maintain the proper one handed squeezing grip on the tool's handle.

It is possible for a cable installer, therefore, to purchase two separate cable end compressor tools. One tool sized for the RG59, and one tool sized for the RG6 cable. This is an expensive solution.

Another solution is to use a Cablematic or compression tool. The Ripley Company of Cromwell, Conn. manufactures the Cablematic® device. The Ben Hughes Communicating Products Company of Chester, Conn. manufacturers the Cable Prep device. These tools are suitable for compressing both RG59 and RG6 cable ends. However, a bolt must be loosened, and then an end plate rotated, and then the bolt re-tightened when switching from the RG59 to the RG6 cable. These are time consuming steps. Furthermore, a special calibrating gauge is required to set the proper tolerances.

The present invention features a hinged spacer which can be flipped out of the way when compressing the larger RG6 cable. The hinged spacer can be flipped up against the fixed end of the compressor tool, thereby accommodating the shorter RG59 female connecting collar. Additionally, the RG6 connector body itself is used as the calibration device, thereby eliminating the need for a separate calibrating gauge.

In summary, the present invention solves the problem of providing a single cable end compressor tool capable of handling both RG59 and RG6 cables. The present invention converts quickly from RG59 to RG6 by utilizing a hinged spacer. The present invention eliminates the need for disassembly and re-assembly of a cable end compressor tool for handling various cables. The present invention also eliminates the need for a separate calibration device.

SUMMARY OF THE INVENTION

The primary object of the present invention is to provide a single cable end compressor tool having a hinged spacer, thereby enabling compressing RG59, RG6 or other combinations of cable gauges.

Another object of the present invention is to use the RG6 connector body as the calibration device, thereby eliminating the need for a separate calibration gauge.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 6 is a front plan view of the spacer 5 of FIGS. 1–5.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 2:
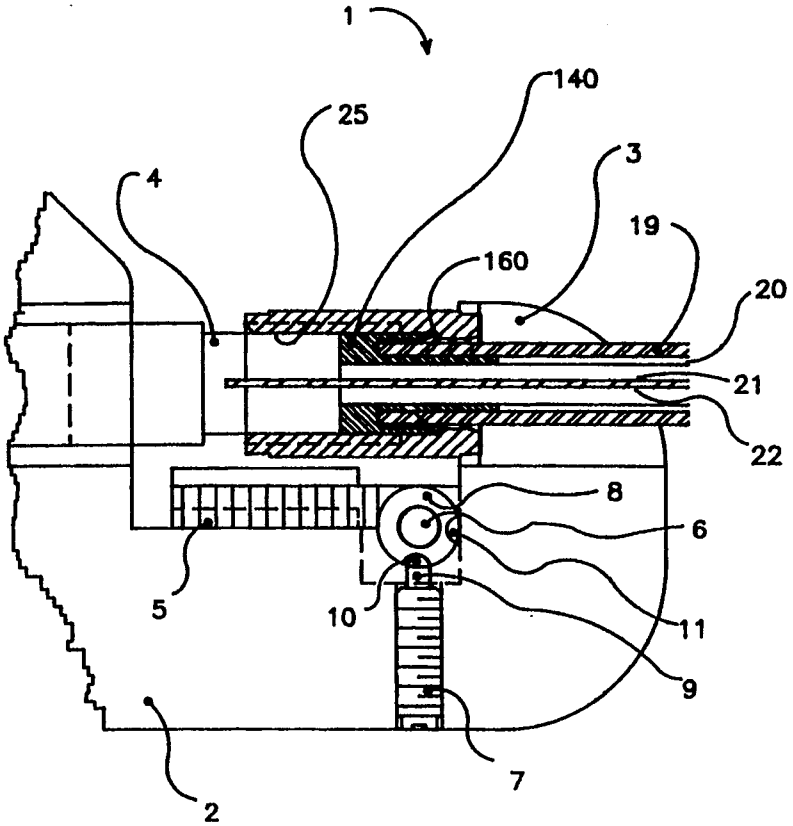
FIG. 2 is the same view as FIG. 1 showing the plunger compressing the mandrel of the connector body around a coaxial cable end.
Figure 1:
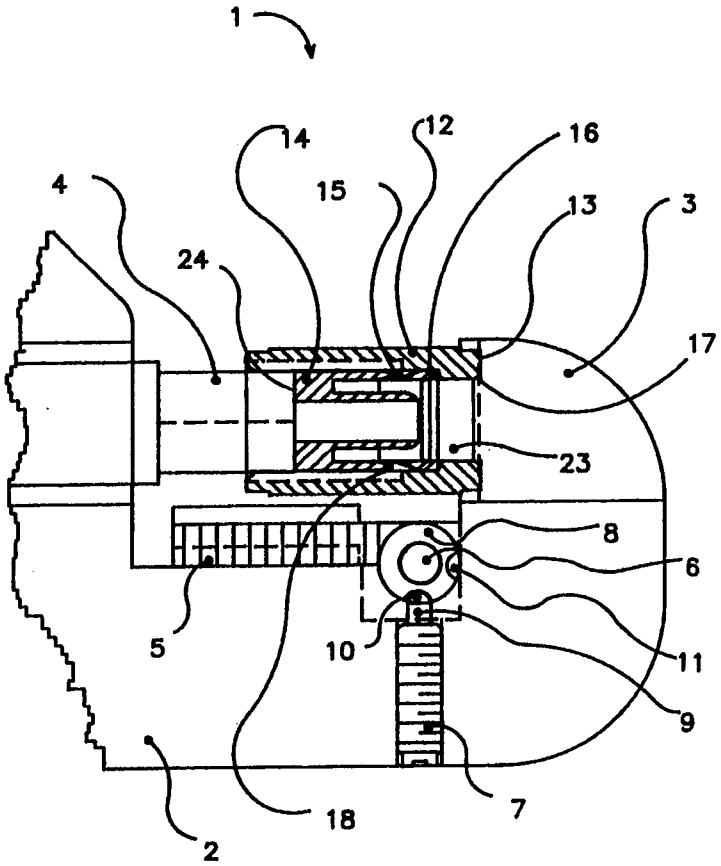
FIG. 1 is a longitudinal sectional view of the working end of the present invention, a crimper, having an RG6 connector body on the plunger.

Referring first to FIGS. 1, 2 a crimper 1 is shown before the crimping operation in FIG. 1 and after the crimping operation in FIG. 2. The crimper has a body 2 which supports a connector support end 3 and a plunger 4. A connector case 12 is an RG6 type with a length 1 of 9/16 inch. The plunger 4 supports the connector case 12 by insertion inside the hollow core 23 of the connector case 12. The hollow core 23 houses a sliding mandrel 14 which has a flat front end 24. The outside rear edge 18 of the mandrel 14 touches the thinnest neck of a frustro conical compression ring 16. An open space 15 exists between the outside rear edge 18 of the mandrel 14 and the compression ring 16. The outside of the compression ring 16 is fixedly engaged with the inside rear surface 17 of the connector case 12.

During the crimping operation an end of a coaxial cable is stripped to expose the cable central conductor 22, the cable dielectric 21, the cable braid 20, and the cable sheath 19 as shown in FIG. 2.

Then the outside rear edge 18 of the mandrel 14 and the compression ring are pressed against the exposed braid 20. Next the plunger 4 imposes upwards of 800 lbs on the flat front end 24 of the mandrel 14. This force compresses both the mandrel 14 and the compression ring 16 in a known manner around the cable sheath 19, thereby forming an effective EMI coupling. This process is substantially described in U.S. Pat. No. 4,583,811 (1986) to McMills which is incorporated herein by reference. The compressed mandrel is designated 140, and the compressed compression ring is designated 160.

The compressed mandrel 140 can slide inside the hollow core 23, thereby enabling the threads 25 to mate with a male connector (not shown).

The novelty of the present invention centers on the spacer 5 and the spacer hinge 6. The spacer hinge 6 has a spacer toggle having a down detent 10 and an up detent 11. The shot spring plunger 7 pushes the latch 9 into either the down detent 10 as shown (for handling an RG6 connector) or the up detent as shown in FIG. 5 (for handling an RG59 connector).

The width w of the spacer is equal to the difference in length between the RG6 connector (length=0.710 inch) and the RG59 connector (length=0.580 inch). Thus w=0.130 inch. In order to hold the spacer 5 in the down or up position without wobbling, the down detent 10 and up detent 11 are each about 0.010 inch off the central axes D,U respectively as shown in FIG. 3.

Raytheon® supplies the RG59 and RG6 connector case 12 and mandrel 14 assembly. Raytheon® specifies that the minimal distance, (G, FIG. 5) for the RG59 connector between the plunger 4 and the connector support end 3 is about 0.295 inch. The minimal distance for the RG6 connector is about 0.425 inch.

Figure 4:
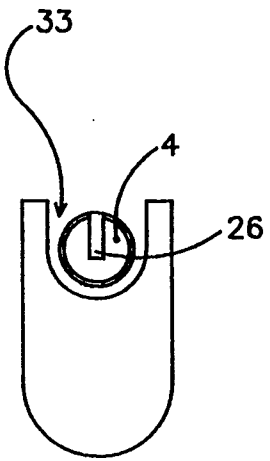
FIG. 4 is a front (working end) plan view taken along line 4–4 of the crimper of FIG. 3.
Figure 3:
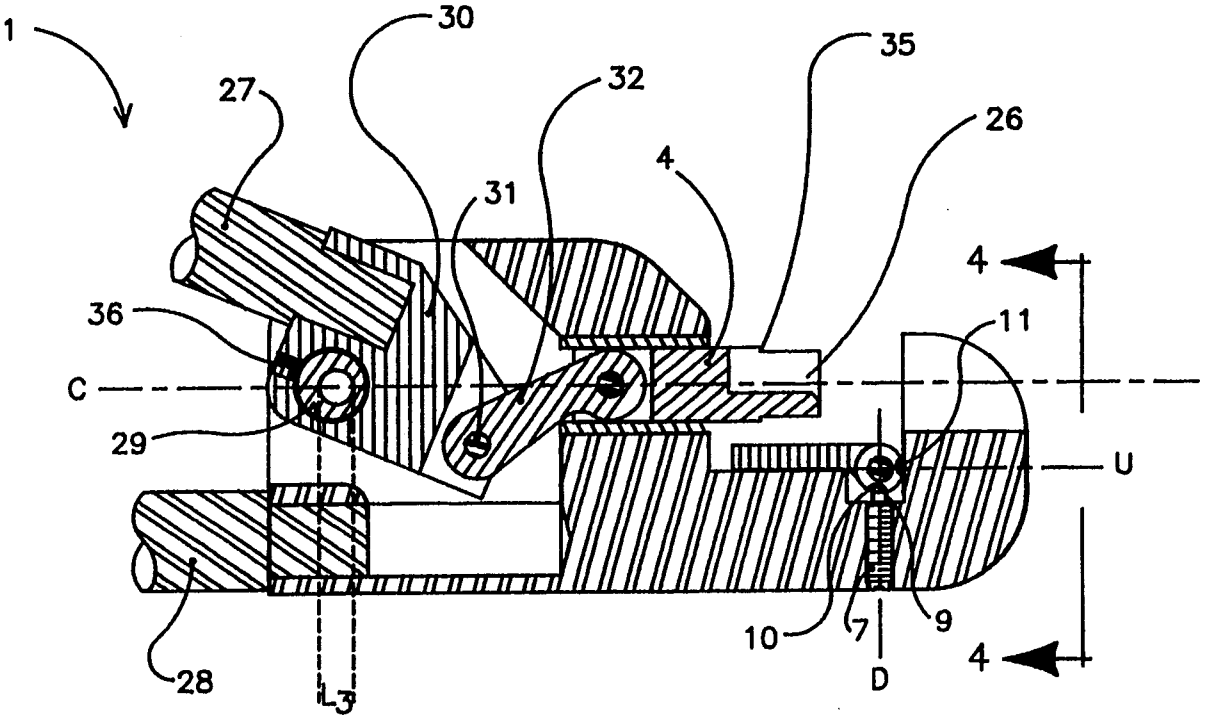
FIG. 3 is a longitudinal sectional view of the crimper of FIGS. 1,2.
Figure 5:
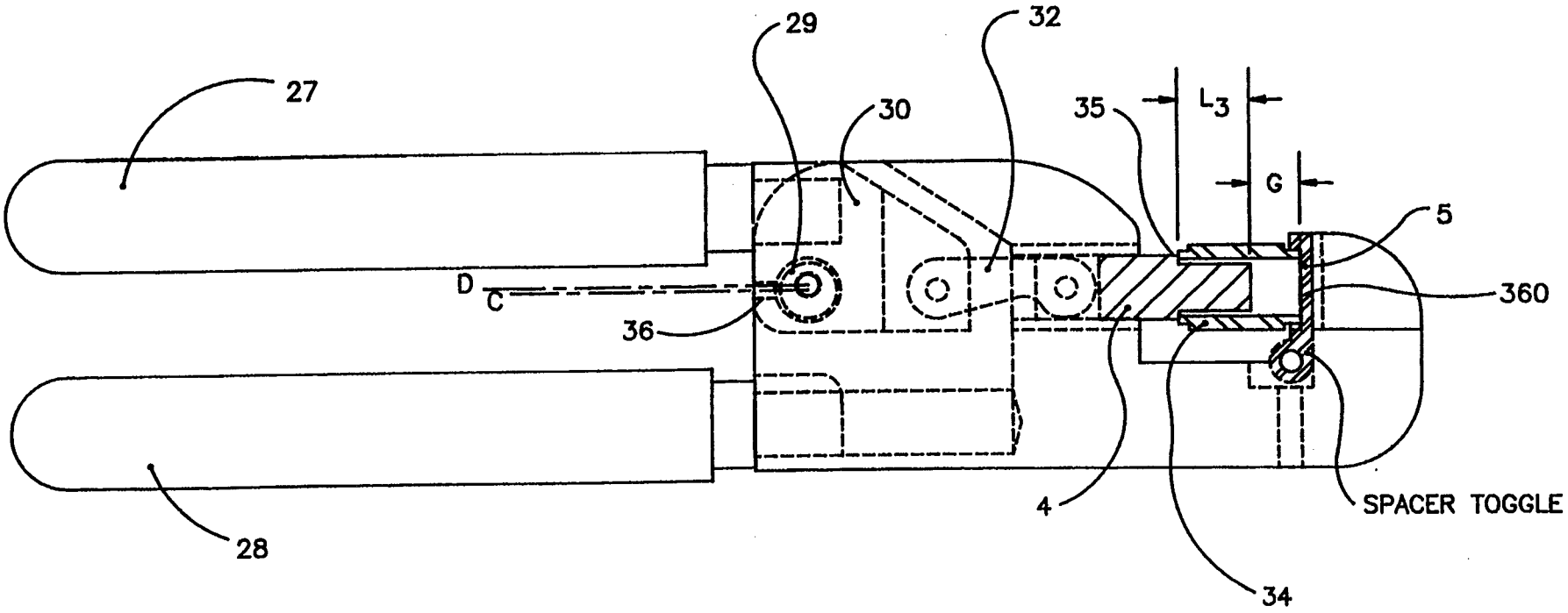
FIG. 5 is a partial longitudinal sectional view of the crimper of FIGS. 1–4 in the calibration mode.

By referring to FIGS. 3,4,5 it is shown how the crimper 1 can crimp either the RG6 or RG59 connectors by merely flipping the spacer 5 to the down position (obtaining the minimal distance 0.395 inch) for the RG6 connectors, or flipping the spacer 5 to the up position (obtaining the minimal distance 0.265 inch) for the RG59 connector.

Furthermore, FIG. 5 shows the method for calibrating the crimper 1 in order to account for factory tolerances and/or wear and tear. It is understood that moving handle 27 is squeezed toward fixed handle 28 around pivot 29. Moving handle 27 down pivots block 30 upward, thereby lifting pivot 31 upward and forward until it reaches the longitudinal axis C of the pivot 29. As pivot 31 moves forward it pushes linkage 32 forward into plunger 4, thereby providing the working compression force of the crimper 1.

Referring next to FIG. 4 a front plan view of the crimper is shown as seen from line 4—4 of FIG. 3. The cable slot 33 enables the cable sheath 19, FIG. 2, to be placed in the working position. The conductor slot 26 of the plunger 4 enables the cable central conductor 22 to slide inside plunger 4 during the crimping operation.

Referring next to FIG. 5 a unique calibration method is shown which does not require a separate gauge. The Raytheon® spec calls for the distance G (minimum plunger 4 distance from the connector support end 3) to be 0.295 inch for the RG59 connector. Wear and tear as well as factory tolerances can affect the lengths of the block 30, the linkage 32, the connector support end 3, and all related moving parts. In order to quickly and easily calibrate the distance G, the spacer 5 is flipped up and an RG6 connector case is placed on the plunger 4 backwards from the normal crimping position. The length 12 of the RG6 case 34 is known to be 0.710 inch. The length 13 from the ridge 35 to the tip 360 of the plunger 4, L3, is known to be 0.415 inch. Therefore, with the handle 27 squeezed down the distance G is known to be 0.295 inch. It should be noted that pivot 29 is eccentric in that its longitudinal axis D is 0.030 inch off axis to axis C. In this manner the set screw 36 can be loosened and the pivot 29 turned to adjust the forward throw of the pivot 29 by ±0.030 inch. For calibration of distance G, the plunger 4 is moved forward by handle 27 until the ridge 35 contacts the RG6 case 34. Then the set screw 36 is loosened. Then the pivot 29 which is eccentric is rotated so that the handles 27, 28 are parallel at the full forward stroke of the plunger 4. Finally the set screw 36 is tightened.

Figure 6:
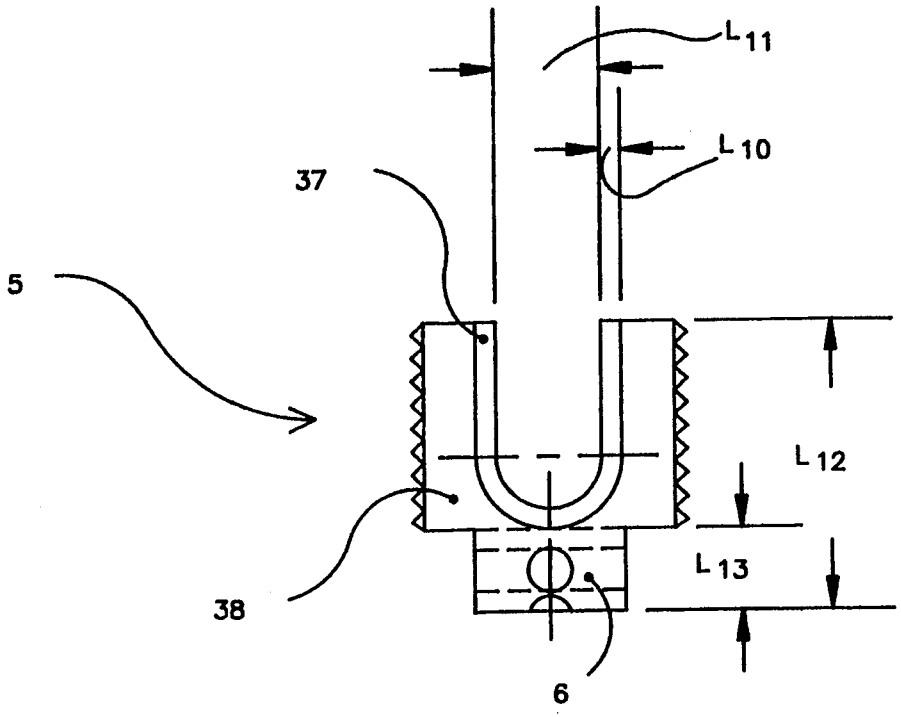
FIG. 6.

Referring last to FIG. 6 the spacer 5 is shown to have a spacer face 38. An optional connector detent 37 is shown to help align a connector (not shown). Nominal dimensions are:

$L_3$=0.415 inch
$L_{10}$=0.060 inch
$L_{11}$=0.315 inch
$L_{12}$=0.875 inch
$L_{13}$=0.250 inch

KEY 1. crimper
2. body
3. connector support end
4. plunger
5. spacer
6. hinge
7. shot spring plunger
8. spacer toggle
9. latch
10. down detent
11. up detent
12. connector case
13. back end of connector case
14. mandrel
15. open space
16. compression ring
17. inside rear surface of connector case
18. outside rear edge of mandrel
19. cable sheath
20. cable braid
21. cable dielectric
22. cable central conductor
23. hollow core
24. flat front end of mandrel
25. threads
26. conductor slot
27. moving handle
28. fixed handle
29. pivot 30. block
31. pivot
32. linkage
33. cable slot
34. RG6 case
35. ridge
36. set screw
37. connector detent
38. spacer face
140. compressed mandrel
160. compressed compression ring Although the present invention has been described with reference to preferred embodiments, numerous modifications and variations can be made and still the result will come within the scope of the invention. No limitation with respect to the specific embodiments disclosed herein is intended or should be inferred.

I claim:

1. A cable end crimping tool comprising:

a body;

a fixed end for supporting a first connector case with a first mandrel, coaxial cable end and compression ring located inside the first connector case;

a plunger reciprocatingly mounted axially opposing the fixed end;

force means to reciprocate the plunger to a minimum distance from the fixed end, thereby urging the first mandrel inside the first connector case a distance L3 toward a back end of the first connector case thereby forming an EMI connection by deforming the compression ring around the coaxial cable end;

a spacer adjacent the fixed end, functioning to allow the plunger to urge a second mandrel inside a shorter second connector case the same distance L3 when the spacer is positioned against the fixed end; and said spacer further comprising positioning means functioning to move the spacer out of service, thereby not affecting the minimum distance, whereby the first and second connector cases of different lengths can be interchangeably mounted between the fixed end and the plunger by moving the spacer in and out of service by the positioning means.

2. The tool of claim 1 wherein said force means further comprise opposing handles.

3. The tool of claim 1 wherein said positioning means further comprises a hinge.

4. The tool of claim 3 wherein said hinge further comprises an up in service and a down out of service position.

5. The tool of claim 4 wherein said hinge further comprises off center detents, functioning to secure the hinge in position.

6. The tool of claim 2 wherein one handle member further comprises an eccentric pivot, functioning to provide a means of calibration to set the minimum distance minus a spacer thickness as the distance from a ridge on the plunger, when the ridge urges the second connector case against the spacer, to the spacer.

7. A cable end crimping tool for compressing a mandrel around a compression ring against a coaxial cable end inside a connector case comprising:

a body having a connector support end on a first handle, a second handle having a linkage to a reciprocating plunger for reciprocating the plunger towards and away from the connector support end;

a spacer having positioning means on the connector support end to vary two minimum distances between the connector support end and the reciprocating plunger;

said positioning means further comprising a hinge to permit varying the two minimum distances; and said minimum distances further comprising a length of an RG59 and an RG6 connector.

8. The tool of claim 6, wherein the first connector case is a Raytheon ® RG6 and the second connector is a Raytheon ® RG59.

* * * * *